United States Patent [19]

Abbott et al.

[11] 4,421,438

[45] Dec. 20, 1983

[54] SLIDING LEG TOWER

[75] Inventors: Barry J. Abbott, Concord; William H. Silcox, San Francisco, both of Calif.

[73] Assignee: Chevron Research Company, San Francisco, Calif.

[21] Appl. No.: 235,274

[22] Filed: Feb. 17, 1981

[51] Int. Cl.[3] ..... E02B 17/00

[52] U.S. Cl. ..... 405/227; 405/195

[58] Field of Search ..... 405/195, 196, 200, 203, 405/224, 227; 114/264, 265; 175/7

[56] References Cited

U.S. PATENT DOCUMENTS

| | | | |
|---|---|---|---|
| 987,266 | 3/1911 | Smith | 405/196 X |
| 3,294,051 | 12/1966 | Khelstovsky | 405/200 X |
| 3,347,053 | 10/1967 | Manning | 405/227 X |
| 3,533,241 | 10/1970 | Bowerman et al. | 405/227 X |
| 4,127,005 | 11/1978 | Osborne | 405/227 |
| 4,135,841 | 1/1979 | Watkins | 405/196 |

FOREIGN PATENT DOCUMENTS

| | | | |
|---|---|---|---|
| 473849 | 12/1973 | Australia | 405/227 |

*Primary Examiner*—David H. Corbin

*Attorney, Agent, or Firm*—D. A. Newell; E. J. Keeling

[57] ABSTRACT

A compliant offshore drilling and producing structure is disclosed. Axial piles extend from the sea floor above the water's surface and are enveloped by sleeves extending downwardly from a rigid platform. Buoyant chambers attached to the sleeves support most of the platform weight and provide righting stability. The platform weight is supported by the axial piles through hydraulic means.

7 Claims, 1 Drawing Figure

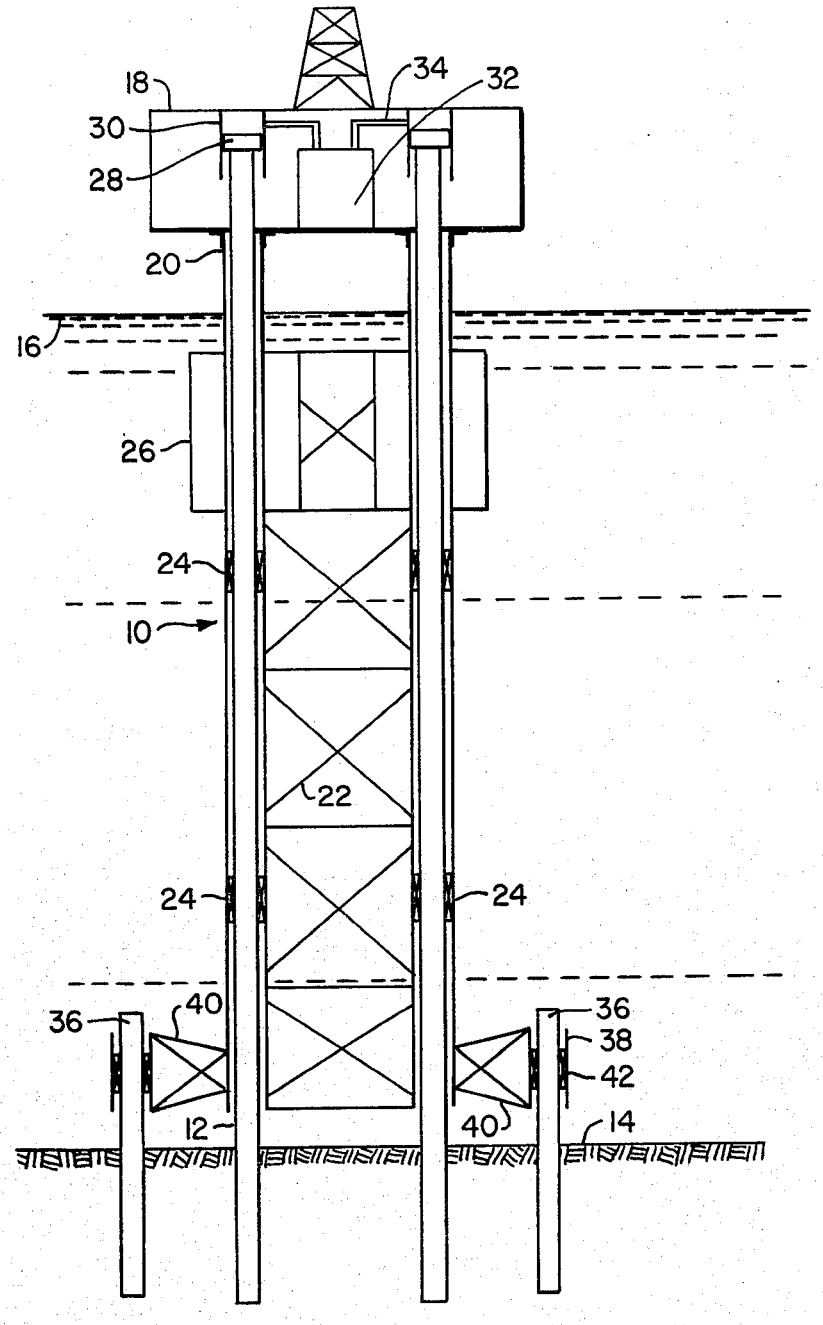
18
34
32
30
28
20
16
26
24
10
22
24
24
36
40
36
38
42
12
40
14

SLIDING LEG TOWER

FIELD OF THE INVENTION

This invention relates to offshore structures for drilling and producing operations. In particular the invention is concerned with a compliant structure suitable for use in water depths in excess of 1,000 feet.

PRIOR ART

The use of offshore structures for drilling and producing operations has become relatively commonplace in recent years. However, as more petroleum fields are being developed in deeper waters, the search continues for structures capable of withstanding the hostile wind and wave forces encountered without being prohibitive in cost.

Two structures proposed in the prior art for operation in water depths greater than 1,000 feet are the guyed tower and the buoyant articulated tower. The guyed tower is a trussed structure that is supported on the ocean floor with a spud can or with pilings. Guy lines run from the deck to fairleads below the water surface to clump weights on the ocean floor. Since the tower will sway a few degrees during the passage of large waves, the well conductors must flex at the tower base. Preferably the fairleads are positioned at about the same elevation as the center of pressure of the applied design wave and wind loads. The environmental forces are therefore, more or less, colinear with the mooring system and the moment transmitted to the tower base is minimized. Beyond the clump weights, the guy lines are attached to suitable fixed anchors. Thus, the clump weights may be lifted from the bottom by heavy storm waves permitting further displacement of the tower.

An articulated buoyant tower differs from the foregoing fixed structure in several important respects. An articulated joint, such as a universal or ball joint, attaches the tower to a pile base thereby permitting the tower to tilt in response to environmental forces. A set of buoyant chambers provides the necessary righting moment and the upward force is effectively negated by a ballast chamber located near the bottom of the tower. The primary objection to such articulated systems arises as a result of the tower's lack of rendundancy and the difficulty of inspection and/or replacement of the articulated joint.

The present invention combines the better features of the above systems in a new and ingenious manner to produce a superior structure for offshore drilling and producing operations.

SUMMARY OF THE INVENTION

The present invention relates to a compliant offshore drilling and producing structure. In accordance with the invention a plurality of axial load piles installed in the sea floor extend upwardly therefrom to a point beyond the upper surface of the water. A rigid platform is provided having a plurality of open ended sleeves affixed thereto and extending downwardly therefrom in a substantially vertical orientation over each of the axial load piles. Buoyant means affixed to the sleeves below the water line are used to support most of the platform weight and provide righting stability to the platform. Further means are provided for supporting the remaining platform weight from the plurality of axial load piles. Preferably these means comprise one or more pistons attached to the ends of each axial pile which extend into hydraulic cylinders secured to the platform. Means are provided for injecting hydraulic fluid into each of the cylinders and preferably all of the cylinders are connected to a single hydraulic circuit.

Bearings are provided between the axial piles and the sleeves to facilitate vertical movement of the sleeves and platform relative to the fixed axial piles. Preferably, at least 75%, and more preferably at least 95% of the sleeve and platform weight is supported by the buoyant chambers affixed to the sleeves. These chambers should further be compartmented to prevent excessive weight from being applied to the axial piles in the event of a rupture in the chambers. If the platform is to be subjected to large lateral loads, skirt piles may also be installed at the base of the structure to absorb part of the horizontal loading.

BRIEF DESCRIPTION OF THE DRAWING

The drawing is a schematic diagram of apparatus suitable for use in the present invention.

DESCRIPTION OF THE PREFERRED EMBODIMENTS

Referring to the drawing there is shown a structure in accordance with the present invention, generally referred to by reference numeral 10. A plurality of axial load piles 12, preferably at least 3 in number, are installed in the sea floor 14 to a suitable depth to provide an adequate resistance against the environmental forces, primarily wind and wave, which may occur. As illustrated, the piles extend upwardly from the sea floor beyond the water's surface 16.

A platform 18 which provides the necessary working space for the drilling and producing operations and which may also provide housing and office space for the crew is situated above the water line beyond the height of the maximum anticipated storm sea.

A plurality of sleeves 20 are rigidly attached in any conventional manner to the platform 18 and extend vertically downward over each of the axial piles. Preferably, the sleeves will extend below the water line at least 75% and preferably 98% of the distance to the sea floor. The sleeves are also preferably cross braced with stiffening trusses 22 substantially along their underwater lengths.

Bearings 24 are provided between the sleeves 20 and the piles 12 to facilitate relative axial movement therebetween. The bearings may be of any suitable and conventional design to lower the frictional forces which would otherwise develop and provide lateral support to the axial piles. Under the conditions of use, the bearings should preferably be designed as a permanent system which will not require replacement during the life of the structure. Where this is not possible, sufficient access should be provided to the components to the bearing system so that it is possible to replace critical elements with minimum dismantling of adjacent components.

Preferably at least 75%, and more preferably 95% of the weight of the entire structure, including the platform and its associated equipment, and excluding the shear piles, will be supported by buoyancy chambers 26 conventionally affixed to the sleeves beneath the water line. Buoyancy chambers 26 provide a righting moment to the tower whenever it sways from a true vertical orientation due to environmental forces. These chambers should be compartmented so that unexpected sealing failures will not unduly burden the foundation pilings.

Normally two sets of buoyant chambers will be used for the structure's tow and installation at the drilling site. The chambers provided for supporting the lower portion of the sleeves during transportation may be flooded to submerge the structure, removed, or shifted towards the upper end of the unit.

The upper end of each foundation pile extends through its associated sleeve as shown in the drawing and is connected to a piston 28. Each piston is housed in a hydraulic cylinder 30 affixed to the platform in a load bearing relationship. Preferably each cylinder is serviced with hydraulic fluid via lines 34 from a single fluid reservoir 32 housed in the platform. If desired, a plurality of pistons and cylinders may be associated with each axial pile. In such a case, at least one piston and cylinder from each pile should be operated from a common fluid reservoir.

The remaining platform and sleeve weight, not supported by the buoyant chambers, is supported by the foundation piling through the hydraulic cylinders, fluid and pistons. This system gives the overall structure the desired degree of compliancy of rotation about the sea floor but resists platform heave or vertical motion.

Skirt piles 36 may also be advantageously used to provide additional lateral support. Unlike the axial load piles, the skirt piles do not extend beyond the water's surface since they are not necessary for carrying vertical loads. Lateral forces are transmitted from the piles via vetically movable sleeves 38 which are rigidly connected to sleeves 20 via trusses 40. Bearings 42 may be used between sleeves 38 and piles 36, if desired to reduce frictional forces.

While use of hydraulic means as set forth above is preferred for coupling the structure sleeves and platform to the axial load piles, it is within the spirit and skill of this invention to use conventional mechanical systems to accomplish the same end.

What is claimed is:

1. An offshore drilling and producing structure, which comprises:

a rigid platform;

a plurality of open-ended sleeves affixed to the platform and extending downwardly therefrom for a substantial distance below the water surface, in a substantially vertical orientation;

an equal plurality of axial piles secured to the sea floor which extends upwardly into said open-ended sleeves to at least a position near the surface of the water;

buoyant means affixed to said sleeves below the water line for supporting most of the platform weight and for providing righting stability; and means for supporting the remaining platform weight from the plurality of axial piles said means permitting simultaneous vertical movement of each of said sleeves with respect to each of said piles to permit a desired degree of compliancy of rotation about the sea floor.

2. An offshore drilling and producing structure as recited in claim 1, further comprising:

bearings situated between said axial piles and said sleeves to facilitate the vertical movement of the sleeves with respect to said piles.

3. An offshore drilling and producing structure as recited in claim 1, wherein at least 75% of the sleeve and platform weight is supported by the buoyant means.

4. An offshore drilling and producing structure as recited in claim 1, wherein at least 3 axial piles are used.

5. An offshore drilling and producing structure as recited in claim 1, wherein the length of the sleeves below the water surface extends at least 75% of the water depth.

6. An offshore and drilling and producing structure as recited in claim 1, wherein said means for supporting the remaining platform weight and for permitting a desired degree of compliancy of rotation about the sea floor includes:

at least one piston secured to the upper end of each of said axial piles in a substantially vertical orientation with respect to the piston axis;

a cylinder for each piston to travel which is secured to the platform; and means for injecting hydraulic fluid into said cylinders.

7. An offshore drilling and producing structure as recited in claim 6, wherein all of said cylinders are connected to a single hydraulic circuit.

* * * * *